US008550189B2

(12) United States Patent
Wolfer

(10) Patent No.: US 8,550,189 B2
(45) Date of Patent: Oct. 8, 2013

(54) DRIVE PIN SUPPORT

(75) Inventor: Dale Richard Wolfer, Salem, VA (US)

(73) Assignee: Atlas Copco Secoroc LLC, Grand Prairie, TX (US)

( * ) Notice: Subject to any disclaimer, the term of this patent is extended or adjusted under 35 U.S.C. 154(b) by 715 days.

(21) Appl. No.: 12/650,704

(22) Filed: Dec. 31, 2009

(65) Prior Publication Data

US 2011/0155471 A1 Jun. 30, 2011

(51) Int. Cl.
*E21B 10/62* (2006.01)
*E21B 17/046* (2006.01)

(52) U.S. Cl.
USPC ..... 175/327; 175/325.2; 408/239 R; 279/80

(58) Field of Classification Search
USPC ..... 175/327, 325.2, 415, 306; 408/231, 408/239 R; 279/80, 99; 29/428
See application file for complete search history.

(56) References Cited

U.S. PATENT DOCUMENTS

| | | | | |
|---|---|---|---|---|
| 989,215 | A | 4/1911 | Walker | |
| 1,124,627 | A | 1/1915 | Leyner | |
| 1,552,892 | A | 9/1925 | Suppler | |
| 1,715,359 | A | 6/1929 | Hansen | |
| 2,477,175 | A | 7/1949 | Gee | |
| 2,703,991 | A | 3/1955 | Kron et al. | |
| 3,517,754 | A | 6/1970 | Hughes | |
| 3,645,114 | A | 2/1972 | Shepherd | |
| 3,753,622 | A * | 8/1973 | Miller | 408/59 |
| 3,933,012 | A | 1/1976 | Ketchum | |
| 4,307,584 | A | 12/1981 | Sandiumenge | |
| 4,702,326 | A | 10/1987 | Salmi et al. | |
| 4,919,221 | A * | 4/1990 | Pascale | 175/415 |
| D393,475 | S | 4/1998 | Jones | |
| 6,131,477 | A | 10/2000 | Gaydek et al. | |
| 7,267,185 | B2 * | 9/2007 | Underwood et al. | 175/325.2 |
| 7,467,675 | B2 * | 12/2008 | Lay | 175/296 |
| 2011/0155471 | A1 * | 6/2011 | Wolfer | 175/327 |

* cited by examiner

*Primary Examiner* — Daniel P Stephenson
(74) *Attorney, Agent, or Firm* — Venable LLP; Eric J. Franklin

(57) ABSTRACT

A chuck assembly, an assembly for an earth-boring drill assembly, and a method of manufacturing a chuck assembly. In the assembly, a first portion of the chuck bore may have a minimum inner diameter greater than the chuck spline maximum inner diameter. A support ring recess may be defined in the bore axially between the chuck splines and the first end. A support ring may be positionable in the support ring recess, and the support ring, when positioned in the support ring recess, may have a support ring inner diameter less than the minimum inner diameter of the first portion of the bore. The drive pin may be positionable circumferentially between one of the chuck splines and an associated one of the bit splines and have an axial end surface at least partially engageable with the support ring to limit axial movement of the drive pin toward the first end.

22 Claims, 5 Drawing Sheets

DRIVE PIN SUPPORT

FIELD OF THE INVENTION

The present invention relates to down-hole drills and, more particularly, a chuck assembly for such a drill.

SUMMARY OF THE INVENTION

Down-hole drills, also known as down-hole hammers, down-the-hole (DTH) drills, and earth-boring drills, are typically fluid-operated and generally include a casing, a piston movably disposed within the casing, and a cutting bit with a cutting surface movably coupled with the casing. The piston is linearly reciprocated within the casing to repeatedly impact the bit so as the drive the cutting surface into a work surface of a hole being drilled. Typically, such drills further include a chuck threaded to the casing and for guiding the movement of the bit and/or the piston. The bit may be movably disposed within a central bore of the chuck, and the bit and chuck have complementary grooves and splines that slidably interact during movement of the bit. Further, the bit is generally secured to the chuck by means of a set of split rings that engage with the outer surface of the bit, such as with a bit groove or shoulder, so as to connect the bit with the chuck.

In one embodiment, the invention may provide a chuck assembly for supporting a bit, the bit having a head and a shank connected to the head, a plurality of radially-outwardly extending bit splines being spaced about an outer circumference of a portion of the shank. The chuck assembly may generally include a chuck, a support ring and a drive pin. The chuck has a body defining a bore extending along an axis between a first end and a second end, the chuck receiving the shank of the bit through the first end such that the bit is supportable by the chuck. The chuck includes a plurality of radially-inwardly extending chuck splines formed in the bore proximate the second end, the chuck splines being spaced about an inner circumference of the bore, adjacent ones of the chuck splines being separated by a groove, a chuck spline maximum inner diameter being defined between grooves on opposite sides of the axis. A first portion of the bore is defined between the chuck splines and the first end, and the first portion of the bore may have a minimum inner diameter greater than the chuck spline maximum inner diameter. A support ring recess may be defined in the bore axially between the chuck splines and the first end.

The support ring may be positionable in the support ring recess, and the support ring, when positioned in the support ring recess, may have a support surface facing toward the chuck splines and a support ring inner diameter. The support ring inner diameter may be less than the minimum inner diameter of the first portion of the bore. The drive pin may be positionable circumferentially between one of the chuck splines and an associated one of the bit splines, the drive pin being operable to transmit rotational torque from the one of the chuck splines to the associated one of the bit splines, the drive pin having an axial end surface at least partially engageable with the support surface of the support ring to limit axial movement of the drive pin toward the first end.

In some constructions, the chuck spline maximum inner diameter may be greater than the support ring inner diameter. A chuck spline minimum inner diameter is defined between chuck splines on opposite sides of the axis, and the chuck spline minimum diameter may be less than the support ring inner diameter.

In some constructions, the support ring may include an annular spring member. The support ring recess has a recess diameter, and, in a free state, the spring member may have an outer diameter greater than the recess diameter such that the spring member is in a compressed state in the support ring recess. The support ring may be removably positionable in the support ring recess. In other constructions, the support ring may be non-removably positionable in the support ring recess.

In some constructions, the drive pin has a circumferential pin width, and the support ring has opposite ends defining a circumferential gap with a gap width. The gap width may be less than the pin width. The assembly may include a plurality of drive pins, each of the plurality of drive pins being positionable circumferentially between one of the chuck splines and an associated one of the bit splines, each of the plurality of drive pins being operable to transmit rotational torque from the one of the chuck splines to the associated one of the bit splines, each of the plurality of drive pins having an axial end surface at least partially engageable with the support surface of the support ring to limit axial movement of the drive pin toward the first end. The chuck splines may be formed of steel, and the drive pin may be formed of a polymer material.

In another embodiment, the invention may provide an assembly for an earth-boring drill, the drill including a casing. The assembly may generally include a drill bit, a chuck, a support ring and a drive pin. The drill bit includes a head and a shank connected to the head, a plurality of radially-outwardly extending bit splines being spaced about an outer circumference of a portion of the shank. The chuck has a body defining a bore extending along an axis between a first end and a second end, the chuck receiving the shank of the bit through the first end such that the bit is supportable by the chuck. The chuck includes a plurality of radially-inwardly extending chuck splines formed in the bore proximate the second end, the chuck splines being spaced about an inner circumference of the bore, adjacent ones of the chuck splines being separated by a groove, a chuck spline maximum inner diameter being defined between grooves on opposite sides of the axis. A first portion of the bore is defined between the chuck splines and the first end, and the first portion of the bore may have a minimum inner diameter greater than the chuck spline maximum inner diameter. A support ring recess may be defined in the bore axially between the chuck splines and the first end.

The support ring may be positionable in the support ring recess, and the support ring, when positioned in the support ring recess, may have a support surface facing toward the chuck splines and a support ring inner diameter. The support ring inner diameter may be less than the minimum inner diameter of the first portion of the bore. The drive pin may be positionable circumferentially between one of the chuck splines and an associated one of the bit splines, the drive pin being operable to transmit rotational torque from the one of the chuck splines to the associated one of the bit splines, the drive pin having an axial end surface at least partially engageable with the support surface of the support ring to limit axial movement of the drive pin toward the first end.

In some constructions, a bit spline maximum outer diameter is defined between bit splines on opposite sides of the axis, and the bit spline maximum outer diameter may be less than the support ring inner diameter. The chuck includes a chuck bearing area in the first portion of the bore, and the bit includes a bit bearing area on the shank axially between the bit splines and the head, the bit bearing area, when the bit is supported by the chuck, facing the chuck bearing area and being spaced apart by a distance. A difference between the bit spline maximum outer diameter and the support ring inner diameter may be greater than the distance.

In a further embodiment, the invention provides a method of manufacturing a chuck assembly for supporting a bit, the bit having a head and a shank connected to the head, a plurality of radially-outwardly extending bit splines being spaced about an outer circumference of a portion of the shank. The method may generally include providing a chuck having a body defining a bore extending along an axis between a first end and a second end, the chuck being operable to receive the shank of the bit through the first end such that the bit is supportable by the chuck, and forming a plurality of radially-inwardly extending chuck splines in the bore proximate the second end, the chuck splines being spaced about an inner circumference of the bore, adjacent ones of the chuck splines being separated by a groove, a chuck spline maximum inner diameter being defined between grooves on opposite sides of the axis, a first portion of the bore being defined between the chuck splines and the first end, the first portion of the bore having a minimum inner diameter greater than the chuck spline maximum inner diameter. The forming act may include inserting at least a portion of a forming tool into the first portion of the bore, and operating the forming tool to form the chuck splines and each groove between adjacent ones of the chuck splines. The forming act may include inserting the forming tool through the first end and into the first portion of the bore.

The method may also include providing a support ring recess in the bore axially between the chuck splines and the first end, and positioning a support ring in the support ring recess, the support ring, when positioned in the support ring recess, having a support surface facing toward the chuck splines and a support ring inner diameter, the support ring inner diameter being less than the minimum inner diameter of the first portion of the bore, the support ring being operable to axially support a drive pin positionable circumferentially between one of the chuck splines and an associated one of the bit splines, the drive pin being operable to transmit rotational torque from the one of the chuck splines to the associated one of the bit splines, the drive pin having an axial end surface at least partially engageable with the support surface of the support ring to limit axial movement of the drive pin toward the first end.

One or more independent aspects of the invention will become apparent by consideration of the detailed description, claims and accompanying drawings.

DETAILED DESCRIPTION

Figure 1:
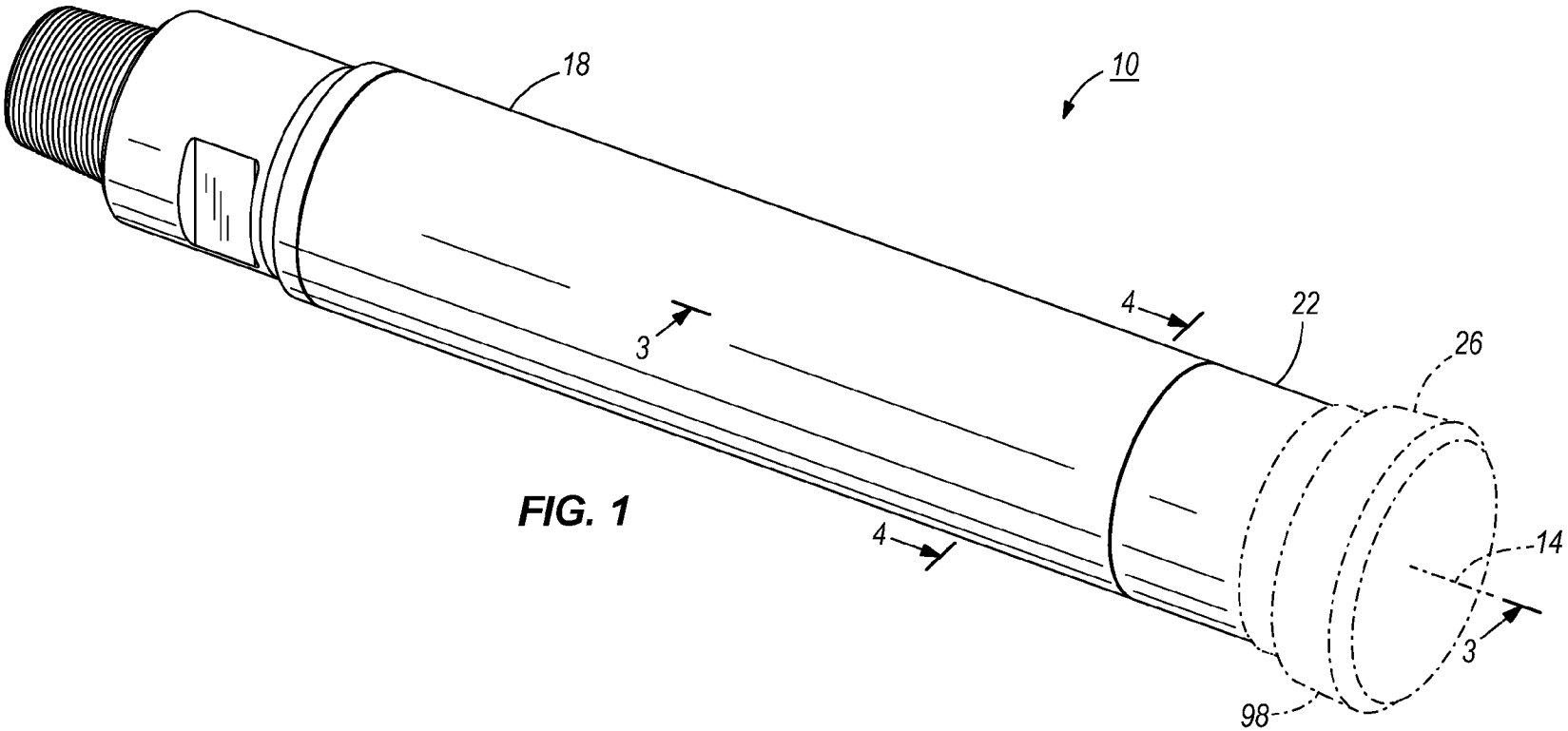
FIG. 1 is a perspective view of a portion of a drill assembly including a chuck assembly.

Before any independent embodiments of the invention are explained in detail, it is to be understood that the invention is not limited in its application to the details of construction and the arrangement of components set forth in the following description or illustrated in the following drawings. The invention is capable of other independent embodiments and of being practiced or of being carried out in various ways.

Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

A down-hole drill assembly 10 is partially illustrated in the drawings. For the sake of simplicity and consistency, the term "axial" means in a direction along or parallel to a central axis 14 of the drill assembly 10 illustrated in the drawings. The elements of the drill assembly 10 discussed below are generally ring-shaped or cylindrical and therefore all have inner and outer surfaces. The terms "inner" or "inwardly" refer to features directed toward the central axis 14 or generally toward the inside of the drill assembly 10, and the terms "outer" or "outwardly" refer to features directed away from the central axis 14 or generally away from the inside of the drill assembly 10. All elements also have first and second ends which, using the convention of the illustrated construction, will be referred to as "top" and "bottom" ends with respect to the typical operating orientation of the drill assembly 10, which orientation is illustrated in Fig. *. Also, terms such as "above", "elevated", "below", etc., describe a relative position while the drill assembly 10 is in the typical operating orientation.

The drill assembly 10 may have both rotary and impact aspects to the drilling operation or may be embodied in a pure down-the-hole ("DTH") drill arrangement in which there is no rotary component. The drill assembly 10 may use substantially any type of drill bit, including a standard bit, drag bit, rotary bit, or another cutting surface suitable for or adaptable to impact loading.

In the illustrated construction (see FIGS. 1-4), the drill assembly 10 generally includes a casing 18, a chuck 22 and a bit 26. The casing 18 defines a central bore 30 (see FIG. 3) for guiding a piston mechanism (partially shown in FIG. 3). The piston mechanism may be any type of piston mechanism usable in a drill assembly and, for example, may be similar to that shown in U.S. Patent Application Publication No. 2008/0078584 A1, published Apr. 3, 2008, and in U.S. patent application Ser. No. 12/369,579, filed Feb. 11, 2009, the entire contents of both of which are hereby incorporated by reference.

Figure 2:
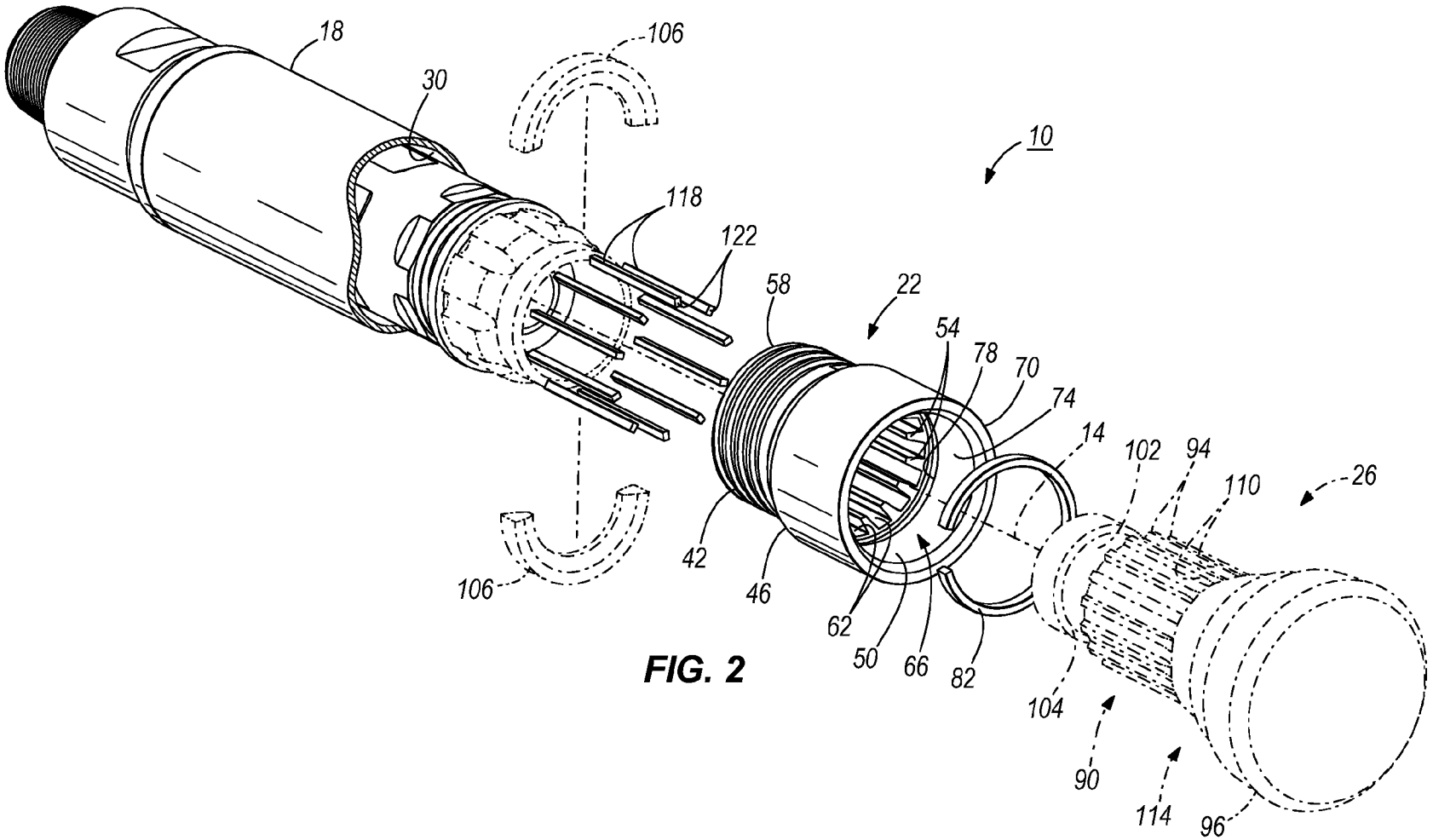
FIG. 2 is an exploded perspective view of the portion of the drill assembly shown in FIG. 1.
Figure 3:
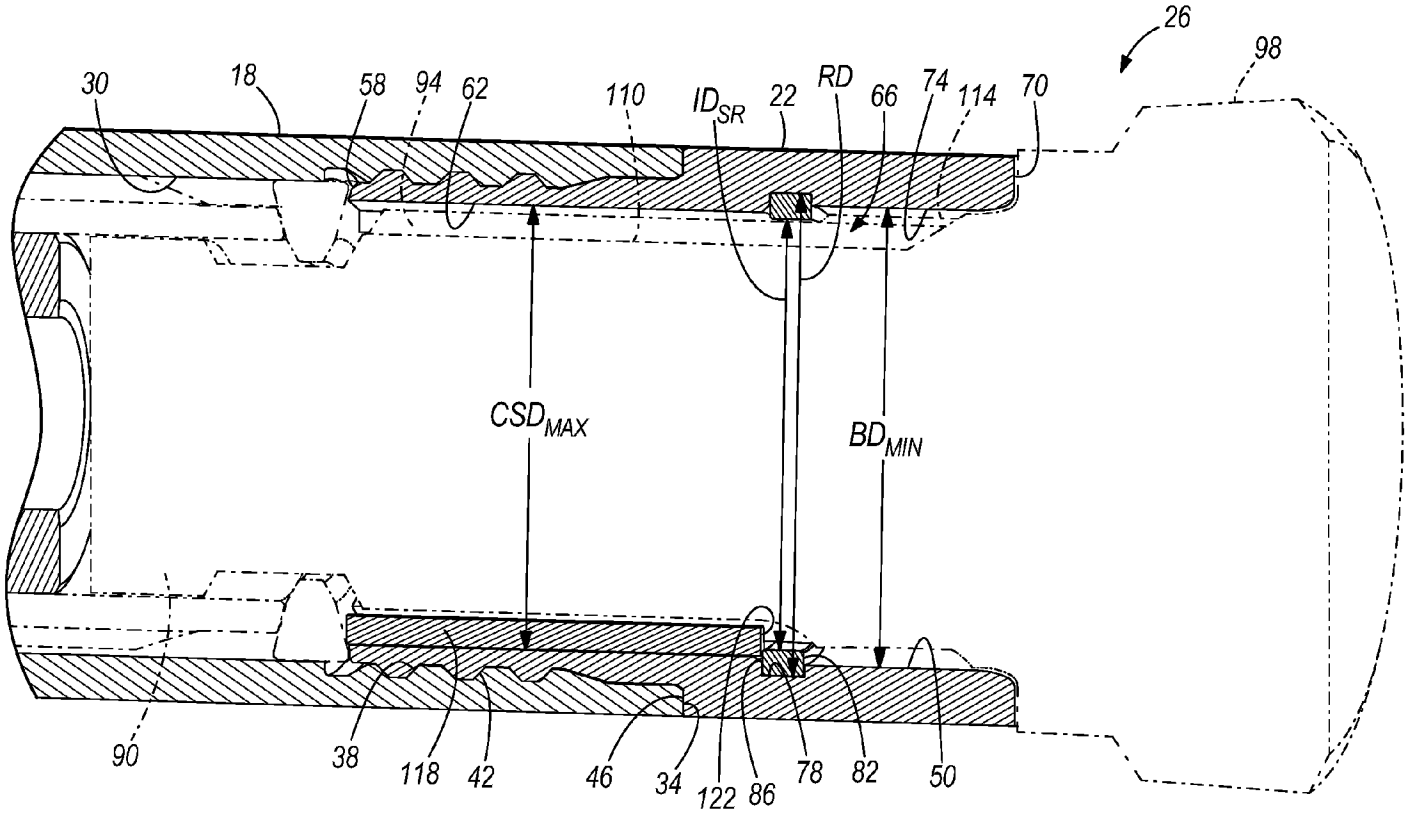
FIG. 3 is a cross-sectional view taken generally along line 3-3 in FIG. 1.
Figure 6:
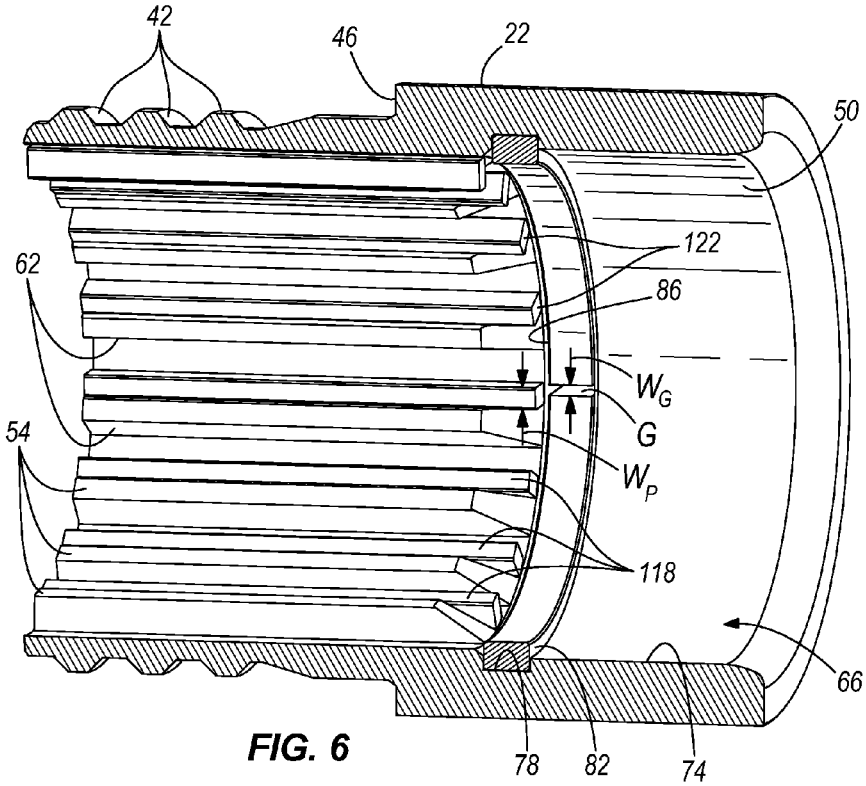
FIG. 6 is a partial cross-sectional side view of a chuck, a support ring and drive pins.

The casing 18 has a bottom end surface 34, and internal threads 38 are defined proximate the bottom end. As shown in FIGS. 2-3 and 6, the chuck 22 has outer threads 42, which mate with the threads 38 to connect the chuck 22 to the casing 18, and an outer shoulder 46, which is engaged by the end surface 34 when the chuck 22 is connected to the casing 18.

Figure 4:
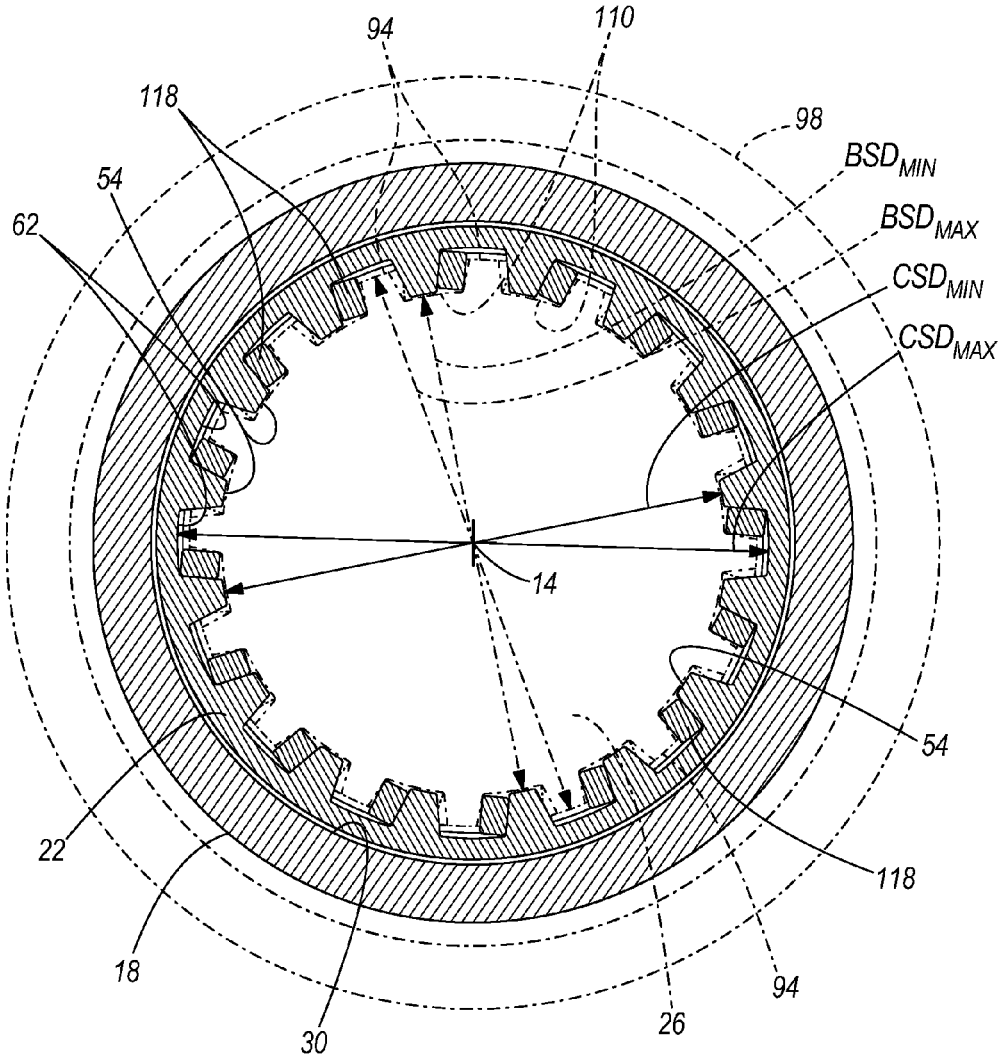
FIG. 4 is a cross-sectional view taken generally along line 4-4 in FIG. 1.

The chuck 22 defines (see FIGS. 2, 4 and 6) a chuck bore 50 and internal splines 54 extending from the upper end 58. The splines 54 extend radially-inwardly into and are spaced about the circumference of the bore 50. Grooves 62 separate adjacent ones of the chuck splines 54. As shown in FIG. 4, a chuck spline maximum inner diameter $CSD_{MAX}$ is defined between the base surface of grooves 62 on opposite sides of the axis 14. In other words, $CSD_{MAX}$ is the diameter of the circle defined by the base surfaces of the grooves 62. A chuck spline minimum inner diameter $CSD_{MIN}$ is defined between the radial end surface of chuck splines 54 on opposite sides of the axis 14, and, similarly, $CSD_{MIN}$ is the diameter of the circle defined by the radial end surfaces of the chuck splines 54.

As shown in FIG. 6, a lower portion 66 of the bore 50 is defined between the splines 54 and the lower end 70. The lower portion 66 of the bore 50 has a minimum inner diameter $BD_{MIN}$. The chuck spline maximum inner diameter $CSD_{MAX}$ is less than or, at most, equal to the minimum inner diameter $BD_{MIN}$ of the lower portion 66 of the bore 50. As shown in FIGS. 2-3 and 6, a chuck bearing area 74 is provided in the lower portion 66 of the bore 50. A support ring recess 78 is defined in the bore 50 axially between the chuck splines 54 and the chuck bearing area 74 and has a recess diameter RD.

To manufacture the chuck splines 54, a forming tool (not shown), such as a cutting tool, shaper, broach, etc., is inserted the bore 50 from either end 58 or 70. The tool is then operated to form the chuck splines 54 and each groove 62 between adjacent ones of the chuck splines 54. Because, as shown in FIG. 6, the minimum inner diameter $BD_{MIN}$ of the lower portion 66 of the bore 50 is greater than the chuck spline maximum inner diameter $CSD_{MAX}$, there is no interference with the tool during insertion and/or operation of the tool to form the full length of the chuck splines 54 and grooves 62, and the splines 54 and grooves 62 can be formed without compromising the cylindrical surface of the chuck bearing area 74. The chuck 22 may thus be formed by efficient methods such as broaching.

As shown in FIGS. 2-3 and 6, a support ring 82 is positionable in the support ring recess 78. The support ring 82, when positioned in the support ring recess 78, has a support surface 86 facing toward the chuck splines 54 and a support ring inner diameter $ID_{SR}$ (see FIG. 6). As shown in FIG. 6, the support ring inner diameter $ID_{SR}$ is less than the minimum inner diameter of the lower portion 66 of the bore 50 such that a portion of the support ring 82 projects inwardly into the lower portion 66 of the bore 50. The chuck spline maximum inner diameter $CSD_{MAX}$ is greater than the support ring inner diameter $ID_{SR}$ such that the support surface 86 projects a radial distance below a portion of the chuck splines 54. In the illustrated construction, the chuck spline minimum diameter $CSD_{MIN}$ is less than the support ring inner diameter $ID_{SR}$ such that the chuck splines 54 project beyond the support ring 82.

In the illustrated construction, the support ring 82 is an annular spring member. In a free state (see FIG. 2), the spring member support ring 82 has an outer diameter greater than the recess diameter RD such that the support ring 82 is in a compressed state when positioned in the support ring recess 78 (see FIGS. 3 and 6). In the illustrated construction (see FIGS. 2 and 6), the support ring 82 is a split ring with opposite ends defining a gap G. As shown in FIG. 6, when the support ring 82 is positioned in the support ring recess 78, the gap G has a gap width $W_G$.

In some constructions, such as the illustrated construction, the support ring 82 is removably positioned in the support ring recess 78 and held in position by the spring force. In other constructions, the support ring 82 may be non-removably positioned in the support ring recess 78, for example, by a shrink fit, welding, etc.

Figure 5:
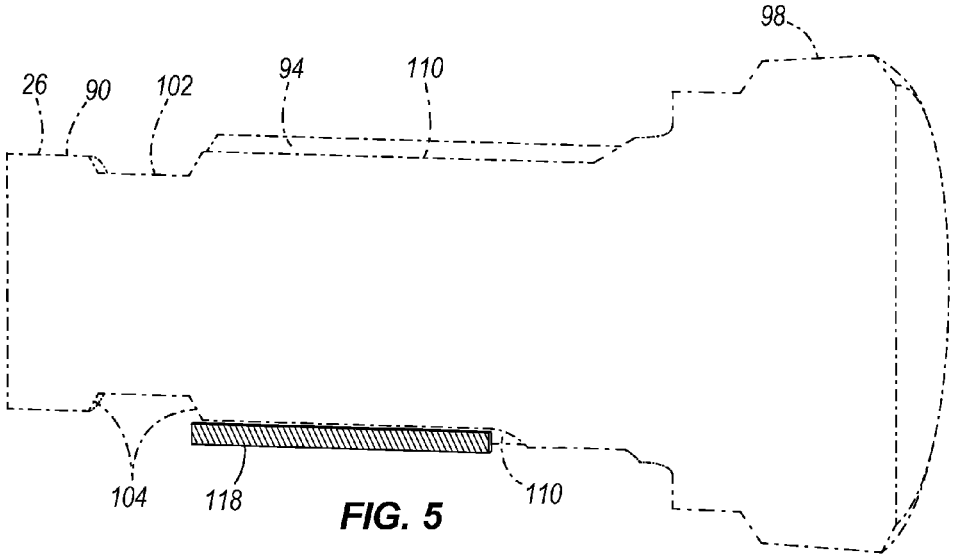
FIG. 5 is a partial cross-sectional side view of a bit and a drive pin.

As shown in FIGS. 2-3 and 5, the bit 26 generally includes a shank 90 providing an anvil, an intermediate portion with external splines 94, and a head 98 having an exterior working surface to bear against rock or other material to be drilled. The bit shank 90 defines an annular groove 102 providing oppositely-facing stopping surfaces 104. When the bit 26 is assembled into the chuck 22, a split ring 106 (see FIG. 3) is positioned in the annular groove 102 to connect the bit 26 to the chuck 22 for drilling operations.

In the illustrated construction, the bit 26 is integrally formed to include the shank 90, intermediate portion and the head 98. In other constructions (not shown), the bit 26 could be formed as a bit retainer having suitable connecting apparatus for receiving a rotary drill bit (e.g., a tricone) or other suitable work piece for rock drilling.

The bit splines 94 project radially-outwardly from and are spaced about a circumference of the intermediate portion of the shank 90. Grooves 110 separate adjacent ones of the bit splines 94. As shown in FIG. 4, a bit spline minimum outer diameter $BSD_{MIN}$ is defined between the base surface of grooves 110 on opposite sides of the axis 14. In other words, $BSD_{MIN}$ is the diameter of the circle defined by the base surfaces of the grooves 110. A bit spline maximum outer diameter $BSD_{MAX}$ is defined between radial end surface of bit splines 94 on opposite sides of the axis 14 and provides the maximum outer diameter of the shank 90 of the bit 26. Similarly, $BSD_{MAX}$ is the diameter of the circle defined by the radial end surfaces of the bit splines 94. In the illustrated construction (see FIG. 3), the bit spline maximum outer diameter $BSD_{MAX}$ is less than the support ring inner diameter $ID_{SR}$.

In the illustrated construction (see FIGS. 2-3 and 5), the bit 26 includes a bit bearing area 114 integrally formed on the shank 90 axially between the bit splines 94 and the head 98. When the bit 26 is supported by the chuck 22 (see FIG. 3), the bit bearing area 114 faces the chuck bearing area 74 and is spaced apart from the chuck bearing area 74 by a distance $D_1$. A difference $D_2$ between the bit spline maximum outer diameter $BS_{MAX}$ and the support ring inner diameter $ID_{SR}$ is greater than the distance $D_1$.

As shown in FIGS. 2-4, drive pins 118 are positionable circumferentially between adjacent one of the chuck splines 54 and the bit splines 94. Each drive pin 118 is operable to transmit rotational torque from the chuck spline 54 to the adjacent bit spline 94. As shown in FIGS. 3 and 6, each drive pin 118 has an axial lower end surface 122, at least a portion of which engages the support surface 86 of the support ring 82 to limit axial movement of the drive pin 118 toward the lower end 70 of the chuck 22. The support ring 82 thus provides a shoulder to support the drive pins 118.

As shown in FIGS. 2-6, each drive pin 118 is generally in the shape of a rectangular prism and has a circumferential pin width W. In the illustrated construction with the split ring support ring 82, as shown in FIG. 6, the width $W_G$ of the gap G in the support ring 82 is less than the pin width $W_P$ such that a drive pin 118 cannot fit through the gap G in the support ring 82.

The chuck splines 54 (and the chuck 22) and the bit splines 94 (and the bit 26) are formed of a metal such as alloy steel. Frictional heat, galling and spalling are leading causes of bit failure, and such failures require time consuming and expensive operations to recover the broken piece of the bit from a borehole. In the illustrated construction, the drive pins 118 are formed of a polymer material and provide a low friction, anti-galling material between the steel elements of the splines 54 and 94 reducing the likelihood of failure the bit 26 and other components.

To assemble, the support ring 82 is positioned in the support ring recess 78 in the chuck bore 50. The bit shank 90 is inserted through the lower end 70 of the chuck 22 into the chuck bore 50. Because (see FIG. 3) the difference $D_2$ between the bit spline maximum outer diameter $BS_{MAX}$ (the maximum outer diameter of the shank 90) and the support ring inner diameter $ID_{SR}$ is greater than the distance $D_1$ between the bit bearing area 114 and the chuck bearing area 74, the bit splines 94 do not engage the support ring 82 to prevent damage of the bit 26 and/or of the support ring 82 during insertion of the bit 26 into the chuck 22.

The splines 54 and 94 are engaged with drive pins 118 between adjacent splines 54, 94 in the forward driving direction (clockwise in FIG. 4) such that torque may be transmitted from the chuck splines 54, through the drive pins 118 and to the bit splines 94 to rotatably drive the bit 26 during operation of the drill assembly 10. As shown in FIG. 3, the split ring 106 is positioned in the annular groove 102 to connect the bit 26 to the chuck 22. For normal operations, axial movement is provided between the bit 26 and the chuck 22 while the splines 54 and 94 remain in torque-transmitting engagement through the drive pins 118. Engagement of the split ring 106 with the opposite stopping surfaces 104 limits this axial movement.

With the chuck 22 and the bit 26 assembled, the unit is connected to the casing 18 by threading the chuck threads 42 into the casing threads 38 (as shown in FIG. 3). The bottom end surface 34 of the casing 18 engages the outer shoulder 46 of the chuck 22.

In operation, when the bit head 98 is not being pushed against rock and the bit 26 is simply subject to forces arising from gravity, the bit 26 is extended downwardly and bottoms out with the upper stopping surface 104 resting on top of the split ring 106. When the bit head 98 is engaged against rock, the bit 26 is pushed upwardly and tops out with the lower stopping surface 104 abutting the bottom of the split ring 106. During drilling, the drill assembly 10 has a rotary component (at least to change the engagement of teeth on the bit 26 with the bottom of the hole) and a percussive component. The impact of a piston (not shown) of the piston mechanism on the bit 26 is transmitted to the rock or other material being drilled, and the bit 26 moves axially in the chuck 22.

As mentioned above, the drive pins 118 provide a low friction, anti-galling material between the steel elements of the splines 54 and 94 reducing the likelihood of failure the bit 26 and other components during drilling operations. The support ring 82 prevents the drive pins 118 from moving toward the lower end 70 of the chuck 22 and out of position between the splines 54 and 94. When compared to existing devices, the support ring arrangement may improve manufacturability of the chuck assembly. In addition, due to a conservative use of radial space, the support ring arrangement may enable use of the chuck assembly in smaller drilling assemblies.

As described above, the invention provides, among other things, a chuck assembly for an earth-boring drill assembly. The invention also provides an assembly for an earth-boring drill assembly. In addition, the invention provides a method of manufacturing a chuck assembly for an earth-boring drill assembly. Various independent features and independent advantages of the invention are set forth in the following claims.

What is claimed is:

1. A chuck assembly for supporting a bit, the bit having a head and a shank connected to the head, a plurality of radially-outwardly extending bit splines being spaced about an outer circumference of a portion of the shank, the chuck assembly comprising:

a chuck having a body defining a bore extending along an axis between a first end and a second end, the chuck receiving the shank of the bit through the first end such that the bit is supportable by the chuck, the chuck including a plurality of radially-inwardly extending chuck splines formed in the bore proximate the second end, the chuck splines being spaced about an inner circumference of the bore, adjacent ones of the chuck splines being separated by a groove, a chuck spline maximum inner diameter being defined between grooves on opposite sides of the axis, a first portion of the bore being defined between the chuck splines and the first end, the first portion of the bore having a minimum inner diameter greater than the chuck spline maximum inner diameter, a support ring recess being defined in the bore axially between the chuck splines and the first end;

a support ring positionable in the support ring recess, the support ring, when positioned in the support ring recess, having a support surface facing toward the chuck splines and a support ring inner diameter, the support ring inner diameter being less than the minimum inner diameter of the first portion of the bore; and a drive pin positionable circumferentially between one of the chuck splines and an associated one of the bit splines, the drive pin being operable to transmit rotational torque from the one of the chuck splines to the associated one of the bit splines, the drive pin having an axial end surface at least partially engageable with the support surface of the support ring to limit axial movement of the drive pin toward the first end.

2. The assembly of claim 1, wherein the chuck spline maximum inner diameter is greater than the support ring inner diameter.

3. The assembly of claim 2, wherein a chuck spline minimum inner diameter is defined between chuck splines on opposite sides of the axis, the chuck spline minimum diameter being less than the support ring inner diameter.

4. The assembly of claim 1, wherein the support ring includes an annular spring member.

5. The assembly of claim 4, wherein the support ring recess has a recess diameter, and wherein, in a free state, the spring member has an outer diameter greater than the recess diameter such that the spring member is in a compressed state in the support ring recess.

6. The assembly of claim 4, wherein the support ring is removably positionable in the support ring recess.

7. The assembly of claim 1, wherein the support ring is non-removably positionable in the support ring recess.

8. The assembly of claim 1, wherein the drive pin has a circumferential pin width, and wherein the support ring has opposite ends defining a circumferential gap with a gap width, the gap width being less than the pin width.

9. The assembly of claim 1, further comprising a plurality of drive pins, each of the plurality of drive pins being positionable circumferentially between one of the chuck splines and an associated one of the bit splines, each of the plurality of drive pins being operable to transmit rotational torque from the one of the chuck splines to the associated one of the bit splines, each of the plurality of drive pins having an axial end surface at least partially engageable with the support surface of the support ring to limit axial movement of the drive pin toward the first end.

10. The assembly of claim 1, wherein the chuck splines are formed of steel, and wherein the drive pin is formed of a polymer material.

11. An assembly for an earth-boring drill, the drill including a casing, the assembly comprising:

a drill bit including a head and a shank connected to the head, a plurality of radially-outwardly extending bit splines being spaced about an outer circumference of a portion of the shank;

a chuck having a body defining a bore extending along an axis between a first end and a second end, the chuck receiving the shank of the bit through the first end such that the bit is supportable by the chuck, the chuck including a plurality of radially-inwardly extending chuck splines formed in the bore proximate the second end, the chuck splines being spaced about an inner circumference of the bore, adjacent ones of the chuck splines being separated by a groove, a chuck spline maximum inner diameter being defined between grooves on opposite sides of the axis, a first portion of the bore being defined between the chuck splines and the first end, the first portion of the bore having a minimum inner diameter greater than the chuck spline maximum inner diameter, a support ring recess being defined in the bore axially between the chuck splines and the first end;

a support ring positionable in the support ring recess, the support ring, when positioned in the support ring recess, having a support surface facing toward the chuck splines and a support ring inner diameter, the support ring inner diameter being less than the minimum inner diameter of the first portion of the bore; and a drive pin positionable circumferentially between one of the chuck splines and an associated one of the bit splines, the drive pin being operable to transmit rotational torque from the one of the chuck splines to the associated one of the bit splines, the drive pin having an axial end surface at least partially engageable with the support surface of the support ring to limit axial movement of the drive pin toward the first end.

12. The assembly of claim 11, wherein a bit spline maximum outer diameter is defined between bit splines on opposite sides of the axis, the bit spline maximum outer diameter being less than the support ring inner diameter.

13. The assembly of claim 12, wherein the chuck includes a chuck bearing area in the first portion of the bore, wherein the bit includes a bit bearing area on the shank axially between the bit splines and the head, the bit bearing area, when the bit is supported by the chuck, facing the chuck bearing area and being spaced apart by a distance, and wherein a difference between the bit spline maximum outer diameter and the support ring inner diameter is greater than the distance.

14. The assembly of claim 11, wherein the chuck spline maximum inner diameter is greater than the support ring inner diameter.

15. The assembly of claim 11, wherein a chuck spline minimum inner diameter is defined between chuck splines on opposite sides of the axis, the chuck spline minimum diameter being less than the support ring inner diameter.

16. The assembly of claim 11, wherein the support ring includes an annular spring member.

17. The assembly of claim 15, wherein the support ring recess has a recess diameter, and wherein, in a free state, the spring member has an outer diameter greater than the recess diameter such that the spring member is in a compressed state in the support ring recess.

18. The assembly of claim 15, wherein the support ring is removably positionable in the support ring recess.

19. The assembly of claim 11, wherein the support ring is non-removably positionable in the support ring recess.

20. The assembly of claim 11, wherein the drive pin has a circumferential pin width, and wherein the support ring has opposite ends defining a circumferential gap with a gap width, the gap width being less than the pin width.

21. The assembly of claim 11, further comprising a plurality of drive pins, each of the plurality of drive pins being positionable circumferentially between one of the chuck splines and an associated one of the bit splines, each of the plurality of drive pins being operable to transmit rotational torque from the one of the chuck splines to the associated one of the bit splines, each of the plurality of drive pins having an axial end surface at least partially engageable with the support surface of the support ring to limit axial movement of the drive pin toward the first end.

22. The assembly of claim 11, wherein the bit splines and the chuck splines are formed of steel, and wherein the drive pin is formed of a polymer material.

* * * * *